99-13 SR
/10/84 XR 4,458,946

United States Patent [19]

Hanna et al.

[11] Patent Number: 4,458,946

[45] Date of Patent: Jul. 10, 1984

[54] SECONDARY OIL SHALE RECOVERY TECHNIQUE

[75] Inventors: Kanaan Hanna, Arvada; Chang Y. Cha; Gordon B. French, both of Golden, all of Colo.

[73] Assignee: Science Applications International, La Jolla, Calif.

[21] Appl. No.: 410,440

[22] Filed: Aug. 23, 1982

[51] Int. Cl.[3] ..... E21C 41/10

[52] U.S. Cl. ..... 299/2; 299/13; 299/19; 166/259

[58] Field of Search ..... 299/2, 5, 13; 166/259

[56] References Cited

U.S. PATENT DOCUMENTS

| | | | |
|---|---|---|---|
| 3,980,339 | 9/1976 | Heak et al. | 299/2 |
| 4,018,280 | 4/1977 | Daviduk et al. | 299/2 |
| 4,063,780 | 12/1977 | Zvejnieks | 299/13 |
| 4,133,580 | 1/1979 | French | 299/2 |
| 4,153,298 | 5/1979 | McCarthy et al. | 299/2 |
| 4,185,871 | 1/1980 | Kvapil et al. | 299/2 |
| 4,230,367 | 10/1980 | McCarthy | 299/2 |

*Primary Examiner*—Stephen J. Novosad
*Assistant Examiner*—Mark J. DelSignore
*Attorney, Agent, or Firm*—Poms, Smith. Lande & Rose

[57] ABSTRACT

Following the conventional mining of rich oil shale for conventional above ground retorting, by horizontally extensive room and pillar mining operations, additional shale oil and related product may be secondarily recovered from the oil shale formation by in-situ retort formation and combustion. The secondary recovery steps would involve initially the identification of a large horizontally extending area, normally located between barrier pillars, which may be blocked off for the in-situ retort. Suitable shale oil drain arrangements may then be provided along one lower edge of this in-situ retorting area. Along the opposite lower edge of the in-situ retorting area, conduits may be provided for withdrawing product gas from the retort area. The retort area may then be sealed, and rubblized by blasting the pillars and caving in the roof to provide the appropriate 15% to 30% void volume for in-situ retorting. Conduits for input air to the rubblized retort volume may be provided along an upper edge of the rubblized volume, diagonally opposed from the product gas conduits, and above the shale oil drainage removal point. The retorting of the rubblized volume, which extends horizontally for a substantially greater distance than its vertical extent, is characterized by a diagonal direction of combustion extending from the air input conduits to the product gas outlet conduits.

18 Claims, 11 Drawing Figures

SECONDARY OIL SHALE RECOVERY TECHNIQUE

FIELD OF THE INVENTION

The present invention relates to the in situ retorting of oil shale, more specifically as applied to the secondary recovery of shale oil and related gaseous products.

BACKGROUND OF THE INVENTION

There are many large deposits of oil shale in the midwestern United States, notably in Colorado and other adjacent states. Oil shale may include calcium magnesium carbonite or dolomite, and organic kerogen material. At elevated temperatures, the decomposition of the organic kerogen contained in the oil shale produces combustible product gases, and shale oil from which fuel and other useful products may be made. Incidentally, the amount of shale oil which may be obtained from oil shale varies considerably with the amount of kerogen included in the oil shale, and may range from a few gallons of shale oil which may be obtained per ton of oil shale, up to as much as 60 or 70 gallons per ton in very rich oil shale. In oil shale formations the richer layers or beds of high grade oil shale will frequently extend through a large formation, often very nearly horizontally, or at a slight angle to the horizontal.

There are two principal broad methods for obtaining the combustible gaseous products and the shale oil from oil shale. The first of these methods involves above-ground retorting, where the rich layers of oil shale are mined from the geological formation and are transported to retorts, normally located near the mining area, for above-ground retorting, in accordance with known techniques. Within the oil shale formation, the mining would characteristically be conducted using both room and pillar mining techniques, in a rich layer of oil shale. In this regard, unless the oil shale was moderately rich in kerogen content, the amount of shale oil and combustible gases which could be obtained would not be sufficiently great to justify the expense of mining and hauling the oil shale to the surface, and the capital investment in the above-ground retorting equipment.

Now, returning to the mine itself, when using so-called "room and pillar" techniques, the height of the rich layer of oil shale which would normally be mined would be about 50 to 70 feet. The supporting pillars which would be left would be characteristically about 50 to 65 feet square, and the spaces between the pillars about 45 feet to 60 feet. Large horizontal areas, perhaps 3,000 to 3,500 feet by perhaps 800 to 950 feet would be blocked off by extended panel barrier pillars. These barrier pillars are required to provide stable long-term haulage and access areas during the mining operation, as well as to isolate sections of the mine for ventilation purposes.

The other principal retorting technique which has been proposed involves what has been termed "modified in-situ" oil shale retorting. Typical patents which disclose in-situ retorting arrangements include U.S. Pat. Nos. 4,133,580 granted Jan. 9, 1979, inventor Gordon B. French; U.S. Pat. No. 4,153,298 granted May 8, 1979, inventors: Harry E. McCarthy and Gordon B. French; and U.S. Pat. No. 4,230,367, granted Oct. 28, 1980, inventor Harry E. McCarthy. In general, in-situ retorted involves the formation of a rubblized mass of oil shale which is characteristically of substantially greater vertical height than horizontal extent. The retorting volume is preferably filled with moderately uniformly sized pieces of oil shale, and the total void volume included within the in-situ retort volume is normally about 15% to 30% of the total volume of the retort. The retorts are normally formed by mining out several horizontal sections from the substantial vertical extent of the intended retort location, and then blasting both from above and below into the mined out volumes. Suitable input and output conduits are located at the top and the bottom of the retort for supplying air and for removing product gases, and suitable drainage arrangements are provided at the bottom of the retort for collecting shale oil, and water, in cases where steam is injected into the retort along with air.

Now, considering the merits of the two different types of retorting systems or techniques as described above, the above-ground retorting arrangements permit a high level of control, and are effective in extracting a large proportion of the shale oil and product gases which are available from the mined oil shale. However, above-ground retorts are capital intensive, and it is relatively expensive to mine the oil shale and transport it to the retorting location. On the other hand, in-situ retorting requires very little capital equipment, as the oil shale formation itself forms the retort. However, when the entire process takes place within the formation, control both as to the sizing of the oil shale and also as to the progress of the retorting is difficult, and accordingly, the yield both in terms of output shale oil and product gases may be somewhat less than for the above-ground retorting method.

Concerning other factors which are involved, in the conventional room and pillar mining of oil shale for above-ground retorts, a fairly large fraction of the high grade shale is left behind in the pillars (typically, 50% to 60%), and a very large fraction of the total oil shale in the formation above and below the high grade zone selected for room and pillar mining is left behind unmined as not being sufficiently rich for the highly capital invensive surface retorts. It is a possibility that some of the oil shale operators might mine a second or even additional horizontal layers of the higher grade shale at some later date, but this is uncertain, and the pillars and the remainder of the shale would still not be utilized. The total resource recovery from such an operation might normally be in the range of 10 to 18% of the total oil shale deposit.

Accordingly, a principal object of the present invention is to provide a secondary oil shale recovery technique, for use following conventional room and pillar operations for above-ground retorting.

SUMMARY OF THE INVENTION

In accordance with the present invention, the oil shale in the pillars and the roof of a conventional horizontally extending room and pillar amine which has been mined out for above-ground retorting, may be rubblized to form an in-situ retort. As mentioned above, the normal volume between the panel barriers of a room and pillar type mining operation would be of very substantial horizontal extent, in the order of nearly 1,000 feet by several thousand feet, with a height of only about 70 feet. Following rubblization of the pillars, and enough of the roof to give a total void volume for the rubblized contents in the order of 15 to 30%, the configuration of the resultant in-situ retort would still have a horizontal extent many times the vertical extent of the retort, unlike conventional in-situ retorts.

In accordance with one aspect of the invention, instead of the usual vertical movement of the combustion front, and the usual horizontal orientation of the combustion front within conventional in-situ retorts, the present method could involve a diagonal movement of the combustion front from one of the upper corners of the rectangular in-situ retort configuration toward the opposite lower corner thereof. Preferably a manifolded set of conduits would be connected to both of these two opposed corners of the retort, and air introduced at one edge and product gases withdrawn at the other edge.

Concerning another important factor, the configuration and the slope of the generally horizontally extending floor of the room and pillar mined out area must be examined, and arrangements prepared for liquid drainage of the shale oil, and possible water, from one of the lower edges or corners of the retort volume. Preferably, but not essentially, the conduits for introducing air into the retort will be located along the edge of the retort above the liquid drainage area where the oil (and possibly water) are to be collected.

Concerning another aspect of the invention, the rubblization is preferably not accomplished by a single explosive blast, as this might cause a significant earth shock or movement; instead, retreat rubblization, either horizontally or diagonally through the retort area is accomplished, whereby successive charges are detonated across the substantial horizontal extent of the room and pillar mine configuration, between adjacent panel barrier pillars.

Incidentally, the conduits connected to the upper edge of the retort volume may either be connected to a manifold below the surface of the earth, or the individual conduits may extend to the surface and be connected to a conduit or manifold above ground. Also, the gas conduits at the lower edge of the retort may angle upward for a short distance, to avoid blockage by oil and possibly water which might otherwise interfere with the gas flow.

Other objects, features and advantages of the invention will become apparent from a consideration of the following detailed description and from the drawings.

DETAILED DESCRIPTION

Figure 1:
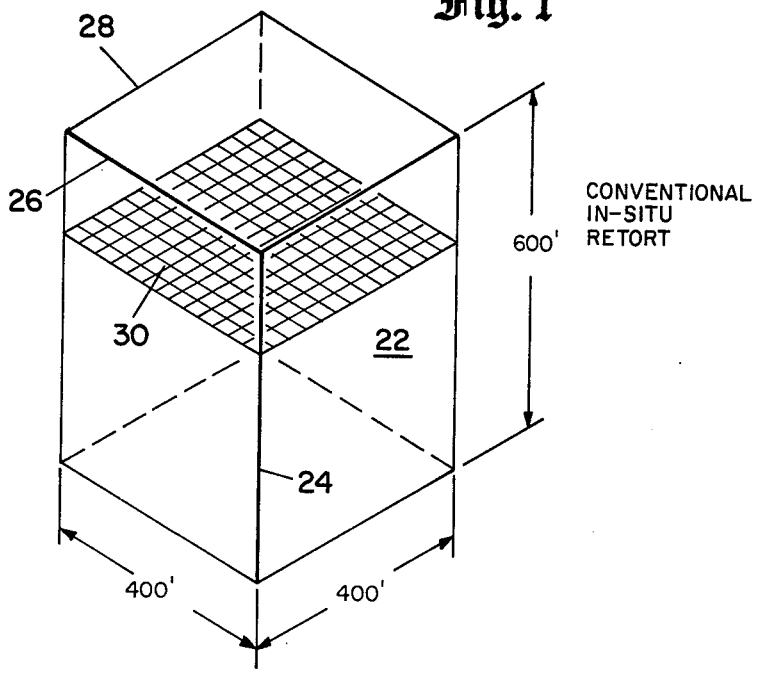
FIG. 1 is a schematic showing of the extent of a conventional modified in situ oil shale retort, as it would be located within an oil shale formation.

Referring more particularly to the drawings, FIG. 1 indicates the configuration of a typical prior art "In-Situ" oil shale retort 22. The retort is normally formed within a large formation of oil shale, which is of course not shown in FIG. 1. It normally has a substantially greater vertical extent as indicated by the side 24 as compared with its horizontal extent as indicated by the sides 26 and 28. By way of example, the sides 26 and 28 could be in the order of 400 feet each, and the vertical extent as indicated by reference numeral 24 could be in the order of 600 feet. The shaded horizontal area 30 indicates the combustion zone within the rubblized mass constituting the in situ retort 22. In accordance with conventional methods for in situ retorts, the combustion zone or flame front is horizontal and travels up or down through the rubblized mass. Characteristically, air inlets are provided across the upper surface of the retort and product gases are withdrawn at the lower surface or in the vicinity of the lower surface of the retort. In addition, shale oil is drained from the bottom of the retort and is withdrawn for utilization. In addition, when steam is injected along with the input air, water may be drawn off along with the shale oil from the bottom of the retort 22, as shown in FIG. 1.

Figure 2:
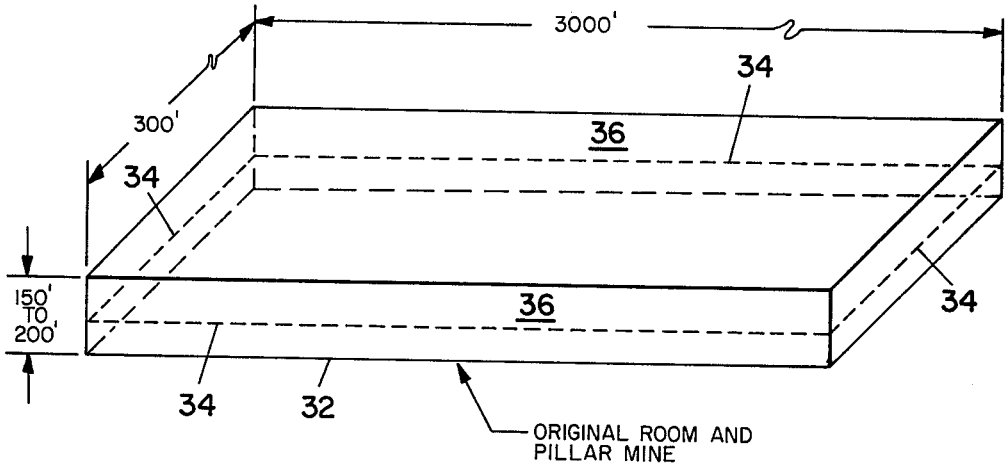
FIG. 2 is a schematic showing of a horizontally extensive in situ retort, illustrating the principle of the present invention.

FIG. 2 is an overall view indicating the substantial horizontal extent of the in situ retorts which, in accordance with the present invention, would be employed for the secondary recovery of oil shale formations, previously mined by room and pillar mining operations. In FIG. 2, the original Room and Pillar mine area is indicated by Reference Numeral 32, and is located below the dashed lines 34. The remainder of the rubblized mass indicated by the reference numerals 36, and which lies above the dashed lines 34, is rubblized by the blasting of the pillars within the zone 32, and by the caving and explosive rubblization of the ceiling above the original conventional room and pillar mine area 32. Following the retreat rubblization, to be discussed below, the void volume of the entire horizontally extending retort will be in the order of from 15% to 30%, as is desirable for in situ retorting.

Figure 3:
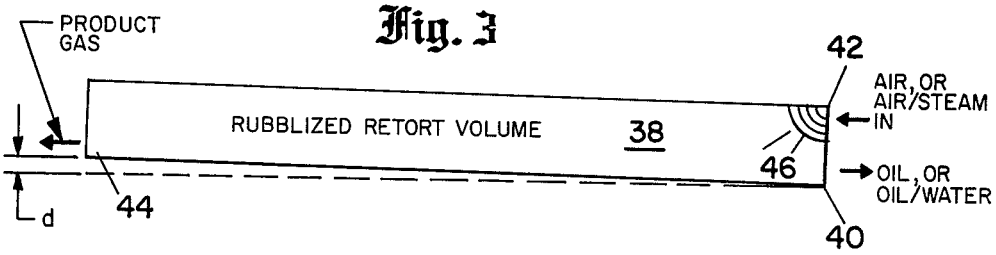
FIG. 3 indicates generally the configuration of the in situ retort in operation.

FIG. 3 is an overall schematic side view illustrating the present invention and will be supplemented by more detailed drawings and discussion hereinbelow. On a general basis, however, an in-situ retort 38 of substantial horizontal extent and limited vertical extent has been formed in an area where an original room and pillar mine was located. The rich layer of oil shale which had been mined, had a slight inclination to the horizontal as indicated by the vertical distance "d" between the left-hand end and the right-hand end in FIG. 3. Accordingly, a suitable sump arrangement has been provided at the lower edge 40 of the retort 38, for draining and collecting the shale oil which is generated as the rubblized material is retorted. With regard to drainage, a slope of one-half foot to one foot per hundred feet is adequate, as long as obstructions are not present to prevent the flow of the liquid. At the edge 40 a suitable channel is prepared for concentrating the flow of oil to a single location where it is withdrawn through a conduit and pumped to the surface for utilization.

At the edge 42 of the horizontally extending in-situ retort 38, input air is supplied as indicated in more detail hereinbelow, and combustion is initiated, in accordance with known techniques. At the opposite edge 44, the product gases are withdrawn. With this arrangement, the combustion front 46 proceeds diagonally through the horizontally extending retort 38, and as combustion proceeds along the length of the retort, product gases will be withdrawn at the edge 44, and shale oil will flow out at edge 40.

FIGS. 1 through 3 are, of course, very schematic in nature, and are intended to emphasize the difference between the secondary recovery process shown in an overall configuration in FIGS. 2 and 3, as compared with conventional in-situ retorting as shown in FIG. 1. More specifically, the normal in-situ retort extends vertically for a substantially greater distance than its horizontal extent, and involves supplying input air over a broad area at the top of the retort to create a horizontal combustion front which moves vertically. This is in contrast to the in-situ retort having a much greater horizontal than vertical extent as shown in FIGS. 2 and 3, and wherein the diagonal movement of the combustion front is accomplished.

Figure 4:
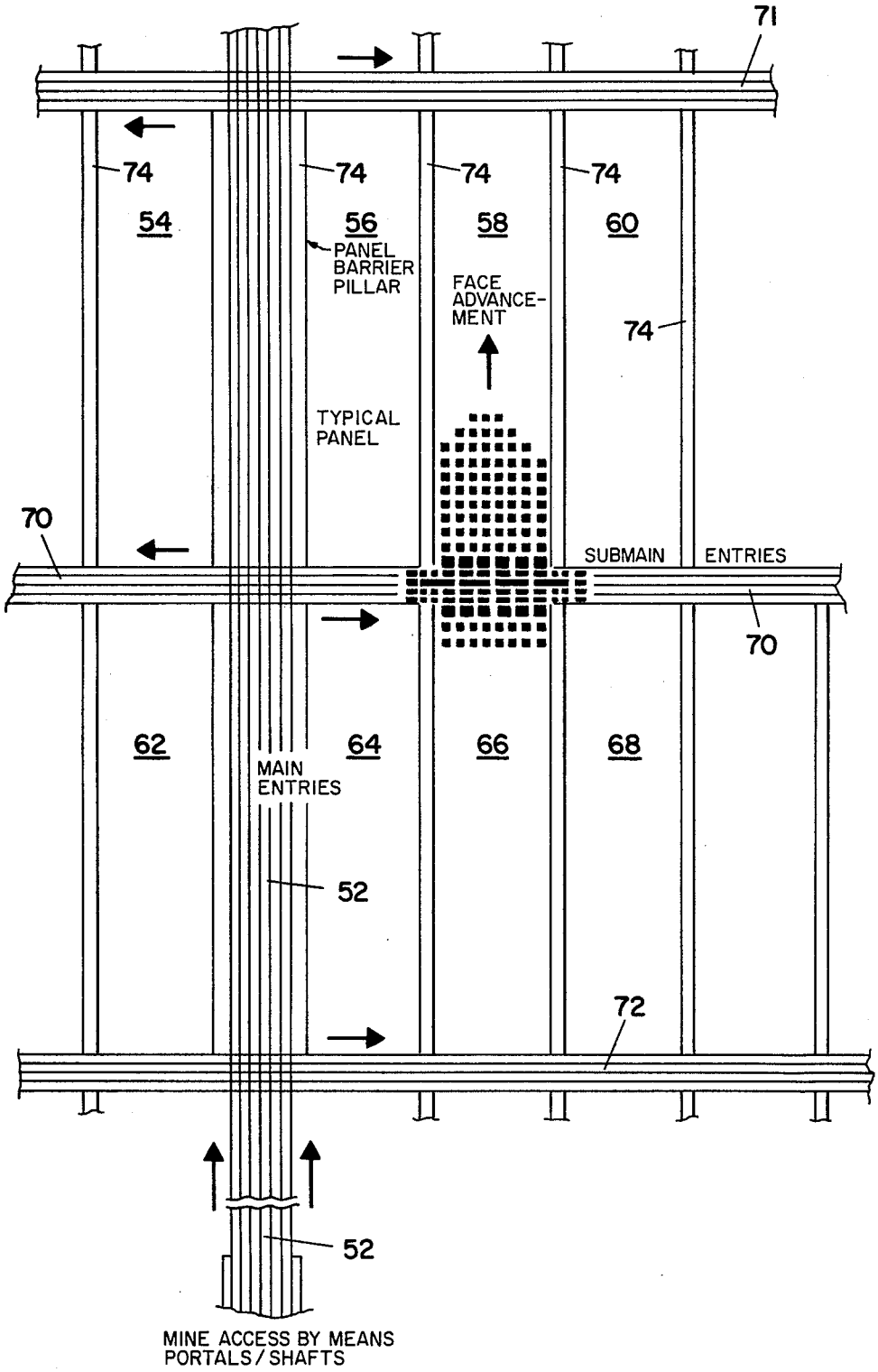
FIG. 4 indicates the overall layout of the typical room and pillar mine.

The present invention will now be developed by considering in greater detail the normal layout of a room and pillar oil shale mining operation for aboveground retorting, and then the conversion of such an operation into in-situ retorts for the secondary recovery of shale oil and related product gases. First, referring to FIG. 4, a typical room and pillar mine layout is shown, with reference numeral 52 showing the main entry to the mine leading in from the bottom of FIG. 4 from the mine access point either provided by portals, or a shaft leading from the surface to the main entry 52. A series of productive panels 54, 56, 58 and 60 are located above the "sub-main" entry corridor 70, and a series of additional panels 62, 64, 66 and 68 are located below the sub-main entries 70 and above entry 72. Barrier pillars 74 are provided on each side of each of the panel areas, and they serve to provide stable long-term access areas during the mining operations, as well as isolating each panel for ventilation, as noted above.

Figure 5:
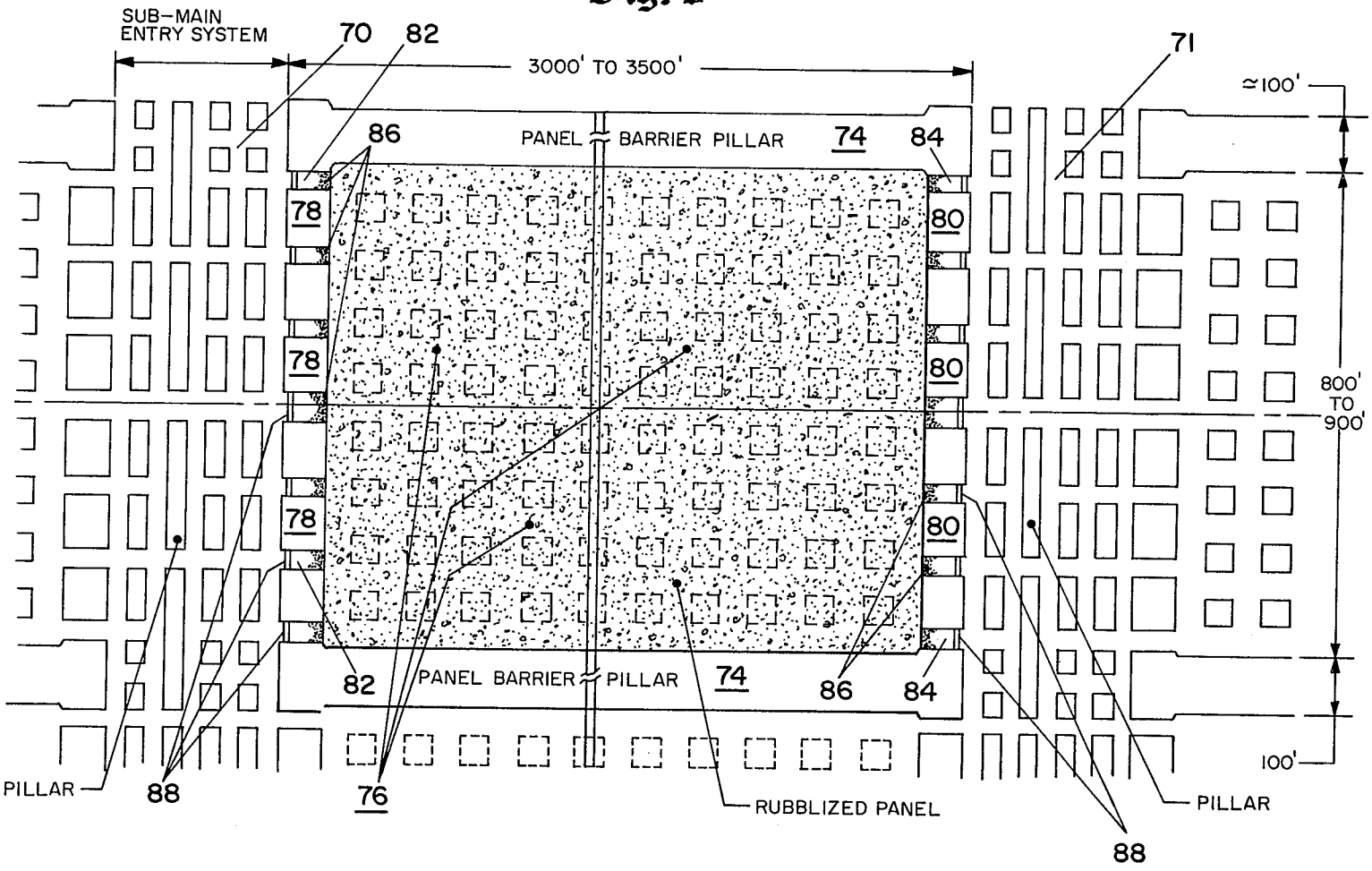
FIG. 5 is a more detailed showing of one section of the room and pillar mine shown generally in FIG. 4.

FIG. 5 shows a typical room and pillar panel layout which may be converted into an in-situ retort. Initially, it may be noted that the panel barrier pillars 74 have the effect of isolating the intended retort area 76 on two of its four sides, at the top and bottom as shown in FIG. 5. In addition, the other two sides of the panel area 76 are closed by the large pillars 78 and 80 which are provided with entryways 82 and 84, respectively, giving access to the panel 76 for use during the time when the room and pillar mining operation was underway for aboveground retorting.

The next step would be the drilling of holes for blasting and rubblization, as discussed in greater detail in connection with FIGS. 6 through 8, below. Another step which is accomplished at this time is to prepare arrangements for the collecting of shale oil produced in the course of the combustion. In the event that there is a significant slope from one end to the other of the panel area 76, the lower end of the area will be selected and a suitable sump prepared for the collection of the shale oil, and, where appropriate, for water from condensed steam. If the entire floor slopes down to a particularly low corner, then this cover may be used as a pump, and liquids may be piped from this point for utilization. At the other end from the sump, at the lower edge of the retort area 76, a series of conduits will be prepared which open into the retort panel area 76. This arrangement will be described in greater detail in connection with FIG. 9 of the drawings. Techniques for loading, blasting, and rubblization will be discussed in greater detail in connection with FIGS. 6 through 8 hereof.

After the rubblization, the panel area 76 will be sealed as depicted in FIG. 5 to separate this panel from adjacent panels undermining development. This may be accomplished by utilizing two types of closures. One closure may employ an inexpensive gunniting cement to form a moderately airtight barrier door between the rooms in the entryway 82 and 84. Secondly, more expensive and tighter bulkhead doors will be constructed on the low pressure end of each exterior entry, isolated from the hot retort zone, by the piles of rubble which have been gunnited. As indicated in FIG. 5, at each of the entries 82 and 84, a pile of rubble 86 will extend partway into each of the entryways. By spraying conventional cement, or a low grade cement made from retorted shale, or a mixture of the two, and utilizing, if desired, simple trusses and other support walls, a substantially airtight initial seal may be formed. This seal, including a substantial thickness of oil shale and cement, will tend to isolate the hot retort area 76. In passing, it is noted that spent oil shale includes a reasonably balanced mixture of calcarous and angitaceous material which when calcined to incipient fusion, will produce a low grade of cement. When hydrated or mixed with a gravel, such as ground shale, the cement makes a reasonably satisfactory concrete, and this concrete may be employed as the initial material for sealing. In certain cases, the entry zone of the retort panel 76, or a series of retort, will require a more positive seal, such as a bulkhead door. For such purposes, a recess may be formed in the walls of the entryways 82 and 84, and a bulkhead door may be sealed into such recesses using concrete or other positive sealant material. The bulkhead door should be constructed including a truss or other structural material, or could be formed of a hemispherical configuration, where the pressure from the retort zone 76, if any, would help to make a tighter seal against the enclosing shale walls. Such additional bulkhead doors 88, are shown toward the outside of the gunnited piles of rubble 86, in FIG. 5.

Figure 6:
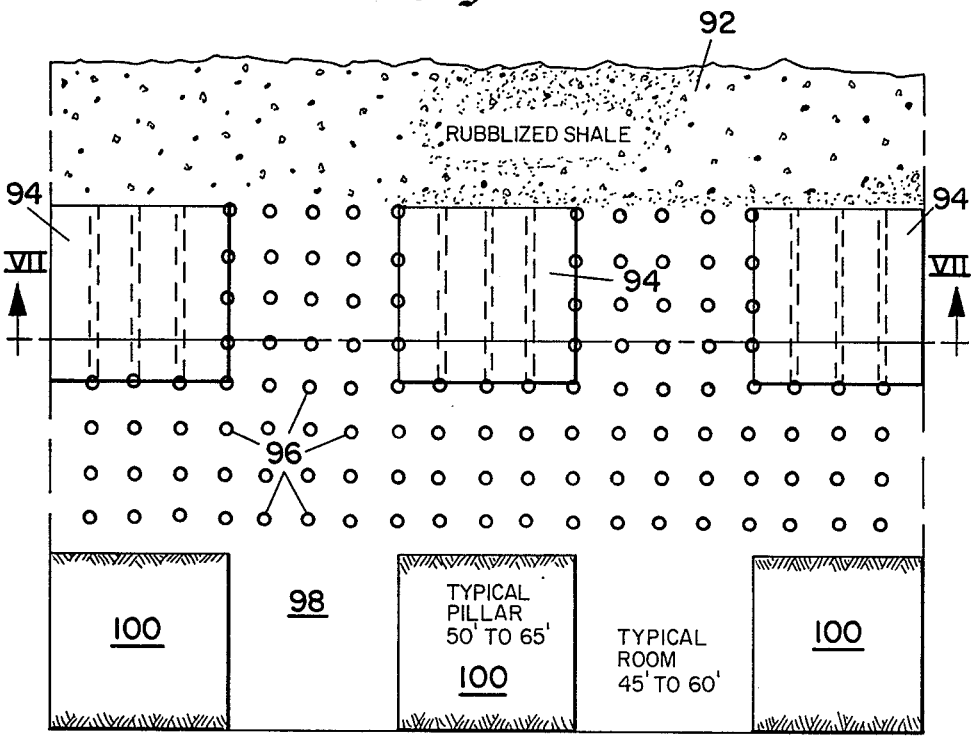
FIGS. 6 and 7 are plan views, and cross-sectional views of a retort showing retreat rubblization by parallel pillar robbing and induced caving.
Figure 7:
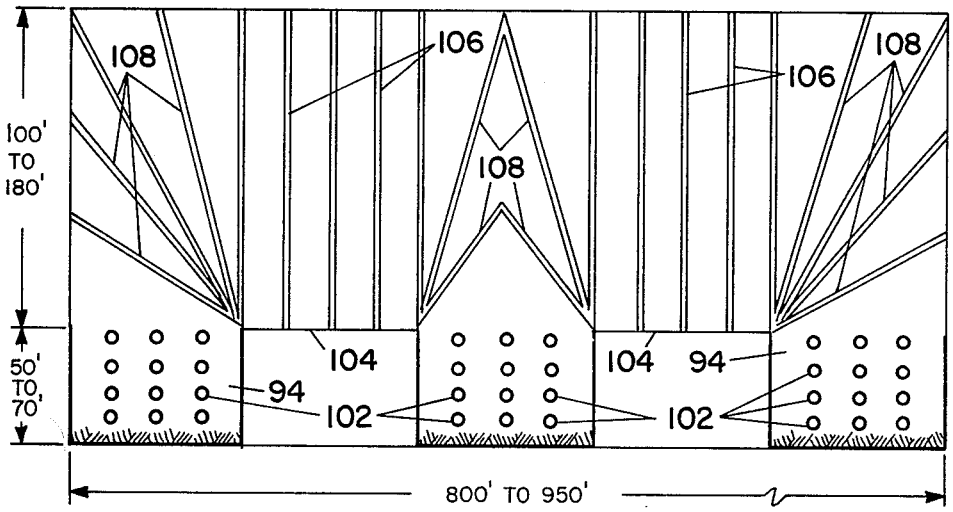

Now, turning to FIGS. 6 and 7, FIG. 6 shows a plan view, and FIG. 7 shows a cross-sectional view of a portion of the retort indicating retreat rubblization by parallel pillar and induced caving. More specifically, in FIG. 6 there is at the top of the figure a zone of rubblized shale 92, and three pillars 94 which have been drilled horizontally for the placement of explosive charges, next a zone where the ceiling or overhead has been drilled as indicated by the bore holes 96 for receiving explosive charges, and finally an area 98 including pillars 100 which has not yet been prepared for blasting and rubblization.

FIG. 7 is a cross-sectional view taken along lines VII—VII of FIG. 6. In FIG. 7, the horizontal holes 102 in the pillars 94 are clearly visible, and these bore holes 102 will soon be loaded for rubblization of these pillars. Above the normal roof 104 of the conventional room and pillar mine area, the ceiling is provided with both vertically drilled bore holes 106, and fan drilled bore holes 108 for caving the roof to provide an appropriate total void volume within the retort area. The vertical holes between the pillars would be in the range of 100 to 180 feet drilled into the roof. The drilling of the pillars horizontally could occur concurrently with the roof drilling.

As illustrated in FIG. 6, for example, the sequence of rubblization within a panel would generally entail drilling and blasting of one row of pillars, often three pillars, and the surrounding roof, as shown in this FIG. 6.

Figure 8:
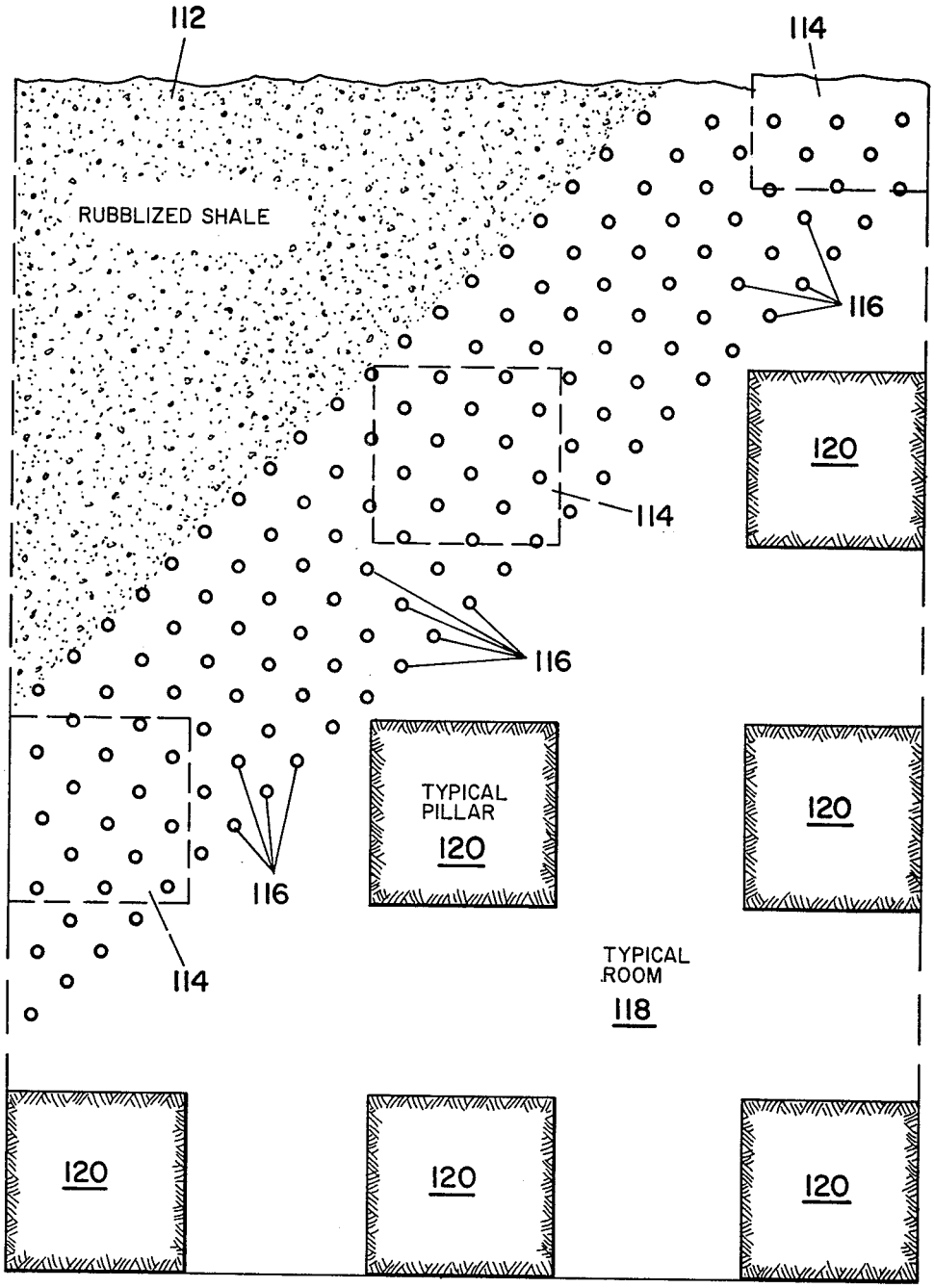
FIG. 8 is a plan view of a retort showing retreat rubblization by diagonal pillar robbing and induced caving.

A preferred alternative to retreat blasting of the pillars in parallel rows as shown in FIG. 6 is illustrated in FIG. 8, where diagonal retreat blasting is shown. This approach will tend to reduce the maximum unsupported roof span. In FIG. 8, the rubblized shale zone is indicated at reference numeral 112, the next pillars to be rubblized are shown at 114, with vertical boreholes 116 extending into the ceiling, and in the area 118 to the lower right in FIG. 8, the pillars 120 have not yet been drilled or rubblized.

Loading and blasting of each segment would commence by millisecond blasting of the row of pillars, and then milliseconds later, the roof. All the holes will be fired on subsequent delays, such that each row will be blasted to the free face created by the preceding row. This procedure of drilling and blasting would continue on a retreat basis until an entire panel such as that shown in FIG. 5 had been rubblized. In each case the drilling would be done far enough ahead of the rubblization to avoid interference.

Figure 9:
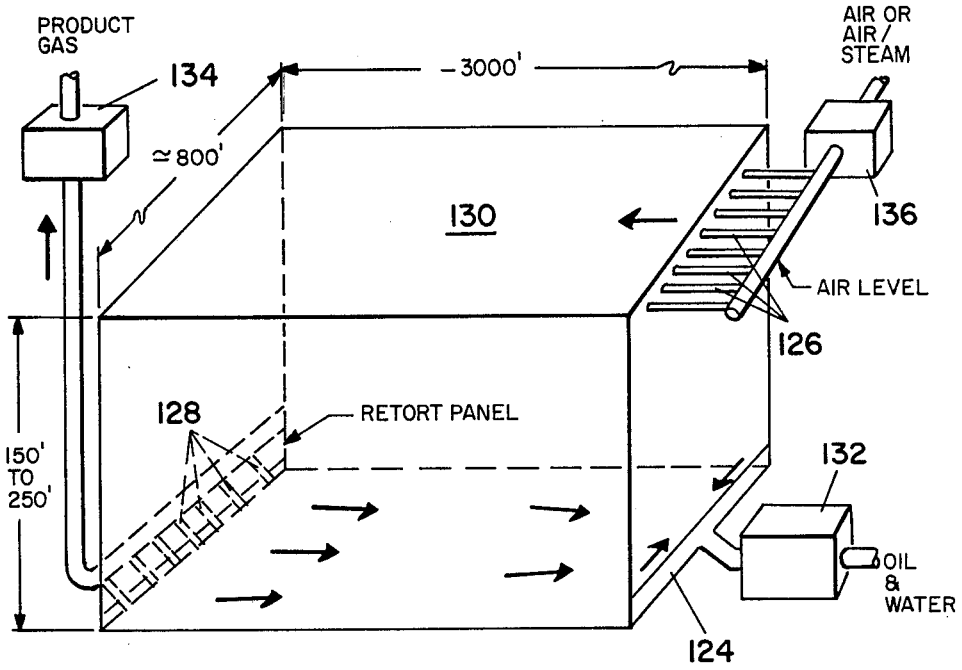
FIG. 9 is an isometric view of the retort arrangement of a horizontally extensive in situ retort of the type under consideration.
Figure 10:
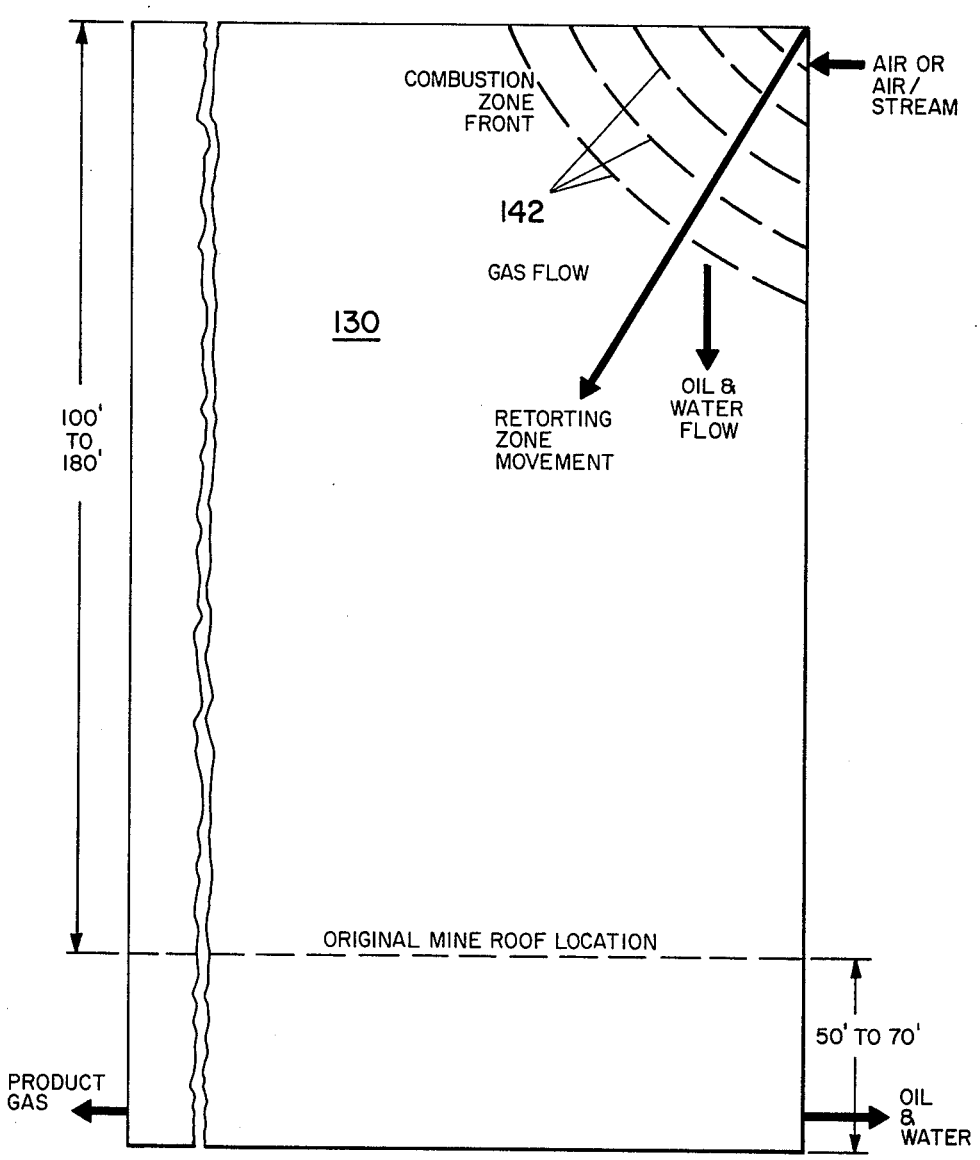
FIG. 10 is a diagrammatic showing of the mode of operation of the arrangement shown in FIG. 9 wherein a combustion zone front proceeds diagonally through the retort.

FIG. 9 is a schematic showing on an overall basis of the mode of operation of a retort illustrating the principles of the present invention. More specifically, note the sump 124 where shale oil is collected, the input air conduits 126 at the upper edge of the retort above the sump arrangements 124, and the product gas outlet conduit 128 at the edge of the retort 130 opposite from the conduits 126. A suitable pump 132 may be provided to pump the collected shale oil to the surface, and suitable fans or blowers 134 and/or 136 may be provided to supply air for limited combustion within the retort 130 and to draw the product gas from the system. Incidentally, as a minor matter, it may be noted that the product gas collection conduits angle up from the edge of the retort, so that they will not become clogged with rubble and/or liquids from the combustion process. FIG. 10 is another schematic showing of the retort 130 of FIG. 9, and indicates successive locations of the combustion zone front 142, as the retort is ignited and the rubblized oil shale burns, under limited combustion conditions.

Figure 11:
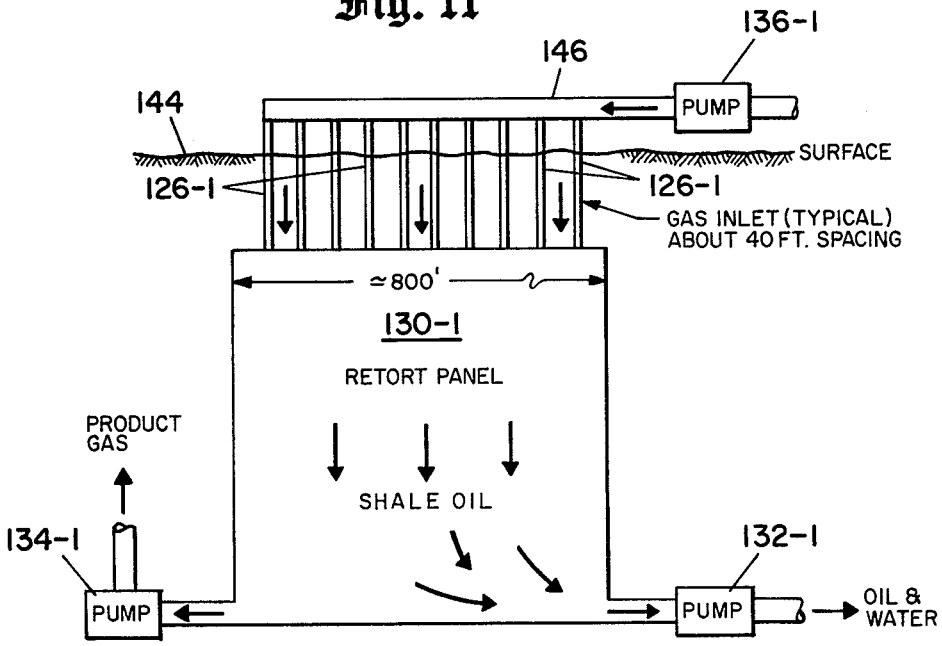
FIG. 11 shows an alternative side view arrangement similar to that of FIG. 9, wherein certain gas conduits extend above-ground to a manifold.

FIG. 11 is included to indicate that the input conduits 126-1 may extend above the surface 144 of the earth or connection to an input manifold pipe 146 through which air is supplied by the pump or fan 136-1.

In conclusion, it is to be understood that the foregoing description and the accompanying drawings merely describe illustrative embodiments of the invention. Other arrangements could be employed to implement the invention. For example, instead of the input air being supplied at an upper edge of the retort, and product gases being collected at the opposite bottom edge of the retort, the input air could be supplied at the bottom edge and the product gases removed from the opposite upper edge, with the resulting combustion front moving diagonally upwardly rather than diagonally downwardly. In addition, other known techniques employed in the in-situ retorting of oil shale could be applied to the present invention. Accordingly, the present invention is not limited to that precisely as shown and described herein.

What is claimed is:

1. A method for the in-situ secondary recovery of shale oil and related product gases from a formation where rich oil shale has been mined for above-ground retorting by conventional horizontally extensive room and pillar mining operations, comprising the steps of:

providing a liquid drainage system for an extended horizontal area between two panel barrier pillars in the conventional mine, said drainage system extending along one lower edge of said horizontal area where the in-situ retorting operation is to take place;

installing conduits to receive product gas from the in-situ retorting operations, along the opposite lower edge of said horizontal area where the in-situ retorting operation is to take place;

sealing said horizontal area where the in-situ retorting is to take place;

rubblizing the pillars included in said horizontal area and inducing caving from the ceiling of the original mine area to produce an in-situ retort having a horizontal extent at least several times its vertical extent, and a void volume of from about 15% to 30%;

installing air inlet conduits extending into the in-situ retort volume along the upper edge thereof above the liquid drainage area and diagonally opposite the edge where the product gas conduits extend to the in-situ retort volume; and initiating combustion adjacent said air inlet conduits while concurrently collecting product gas from said product gas conduits and producing a diagonally moving combustion front, whereby shale oil may be withdrawn from said liquid drainage system below said air inlet conduits while said combustion front moves diagonally from said air inlet to said product gas conduits.

2. A method as defined in claim 1 wherein said rubblizing step includes the rubblization of a volume for in-situ retorting which is at least several times as long and several times as wide as it is high.

3. A method as defined in claim 1 wherein said rubblization is accomplished by the retreat blasting of successive pillars and mine ceiling volumes across the horizontal area where the in-situ retorting is to take place, to reduce blast effects and ground motion.

4. A method as defined in claim 1 including the additional steps of pumping the collected shale oil from the bottom of the retort aboveground.

5. A method as defined in claim 1 including the steps of pumping or drawing air through said inlet conduits into the in-situ retort and concurrently moving product gas through said product gas conduits.

6. A method for the in-situ secondary recovery of shale oil and related product gases from a formation where rich oil shale has been mined for aboveground retorting by conventional horizontally extensive room and pillar mining operations, comprising the steps of:

providing a liquid drainage system for an extended horizontal area between two panel barrier pillars in the conventional mine, said drainage system being associated with a low zone of said horizontal area where the in-situ retorting operation is to take place;

installing conduits to receive product gas from the in-situ-retorting operations, along or adjacent one edge of the volume where the in-situ retorting operation is to take place;

sealing said horizontal area where the in-situ retorting is to take place;

rubblizing the pillars included in said horizontal area and inducing caving from the ceiling of the original mine area to produce an in-situ retort having a horizontal extent at least several times its vertical extent, and a void volume of from about 15% to 30%;

installing air inlet conduits extending into the in-situ retort volume along or adjacent the edge thereof diagonally opposite the edge where the product gas conduits extend to the in-situ retort volume; and initiating combustion adjacent said air inlet conduits while concurrently collecting product gas from said product gas conduits and producing a diagonally moving combustion front, and whereby shale oil may be withdrawn from said liquid drainage system below said air inlet conduits while said combustion front moves diagonally from said air inlet to said product gas conduits.

7. A method as defined in claim 6 wherein said rubblizing step includes the rubblization of a volume for in-situ retorting which is at least several times as wide and several times as long as it is high.

8. A method as defined in claim 6 wherein said rubblization is accomplished by the retreat blasting of successive pillars and mine ceiling volumes across the horizontal area where the in-situ retorting is to take place, to reduce blast effects and ground motion.

9. A method as defined in claim 6 including the additional steps of pumping the collected shale oil from the bottom of the retort aboveground.

10. A method as defined in claim 6 including the steps of pumping or drawing air through said inlet conduits into the in-situ retort and concurrently moving product gas through said product gas conduits.

11. A method for the in-situ secondary recovery of shale oil and related product gases from a formation where rich oil shale has been mined for aboveground retorting by conventional horizontally extensive room and pillar mining operations, comprising the steps of:

providing a liquid drainage system for an extended horizontal area between two panel barrier pillars in the conventional mine, said drainage system being associated with a low zone of said horizontal area where the in-situ retorting operation is to take place;

installing conduits to receive product gas from the in-situ retorting operations, along or adjacent one end of the volume where the in-situ retorting operation is to take place;

sealing said horizontal area where the in-situ retorting is to take place;

rubblizing the pillars included in said horizontal area and inducing caving from the ceiling of the original mine area to produce an in-situ retort having a horizontal extent at least several times its vertical extent, and a void volume of from about 15% to 30%;

installing air inlet conduits extending into the in-situ retort volume along or adjacent the end thereof diagonally opposite the end where the product gas conduits extend to the in-situ retort volume; and initiating combustion adjacent said air inlet conduits while concurrently collecting product gas from said product gas conduits and producing a diagonally moving combustion front, whereby shale oil may be withdrawn from said liquid drainage system below said air inlet conduits while said combustion front moves diagonally from said air inlet to said product gas conduits.

12. A method for the in-situ secondary recovery of shale oil and related product gases from a formation where rich oil shale has been mined for aboveground retorting by conventional horizontally extensive room and pillar mining operations, comprising the steps of:

providing a liquid drainage system for an extended horizontal area between two panel barrier pillars in the conventional mine, said drainage system of said horizontal area where the in-situ retorting operation is to take place;

installing conduits to receive product gas from the in-situ retorting operations, along the lower edge of said horizontal area where the in-situ retorting operation is to take place;

sealing said horizontal area where the in-situ retorting is to take place, sealing step including the gunniting of rubble piles in entryways between panels leading to the in-situ retort volume;

rubblizing the pillars included in said horizontal area and inducing caving from the ceiling of the original mine area to produce an in-situ retort having a horizontal extent at least several times its vertical extent, and a void volume of from about 15% to 30%;

installing air inlet conduits extending into the in-situ retort volume along the upper edge thereof above the liquid drainage area and diagonally opposite the edge where the product gas conduits extend to the in-situ retort volume; and initiating combustion adjacent said air inlet conduits while concurrently collecting product gas from said product gas conduits to produce a diagonally moving combustion front, whereby shale oil may be withdrawn from said liquid drainage system below said air inlet conduits while said combustion front moves diagonally from said air inlet to said product gas conduits.

13. A method as defined in claim 12 wherein the gunniting step includes the use of inexpensive cement made from oil shale.

14. A method for the in-situ secondary recovery of shale oil and related product gases from a formation where rich oil shale has been mined for above-ground retorting by conventional horizontally extensive room and pillar mining operations, comprising the steps of:

providing a liquid drainage system for an extended horizontal area between two panel barrier pillars in the conventional mine, said drainage system extending along one lower edge of said horizontal area where the in-situ retorting operation is to take place;

installing conduits to receive product gas from the in-situ retorting operations, along the opposite lower edge of said horizontal area where the in-situ retorting operation is to take place;

sealing said horizontal area where the in-situ retorting is to take place;

rubblizing the pillars included in said horizontal area and inducing caving from the ceiling of the original mine area to produce an in-situ retort having a horizontal extent at least several times its vertical extent, and a void volume of from about 15% to 30%;

said rubblizing being accomplished by the retreat blasting of successive pillars and mine ceiling volumes diagonally across the horizontal area where the in-situ retorting is to take place, to reduce blast effects and ground motion;

installing air inlet conduits extending into the in-situ retort volume along the upper edge thereof above the liquid drainage area and diagonally opposite the edge where the product gas conduits extend to the in-situ retort volume; and initiating combustion adjacent said air inlet conduits while concurrently collecting product gas from said product gas conduits to produce a diagonally moving combustion front, whereby shale oil may be withdrawn from said liquid drainage system below said air inlet conduits while said combustion front moves diagonally from said air inlet to said product gas conduits.

15. A method as defined in claim 10 wherein the gunniting step includes the use of inexpensive cement made from oil shale.

16. A method for the in-situ secondary recovery of shale oil and related product gases from a formation where rich oil shale has been mined for aboveground retorting by conventional horizontally extensive room and pillar mining operations, comprising the steps of:

providing a liquid drainage system for an extended horizontal area between two panel barrier pillars in the conventional mine, said drainage system being associated with a low zone of said horizontal area where the in-situ retorting operation is to take place;

installing conduits to receive product gas from the in-situ retorting operations, along or adjacent one edge of the volume where the in-situ retorting operation is to take place; said sealing step including the gunniting of rubble piles in entryways between panels leading to the in-situ retort volume;

sealing said horizontal area where the in-situ retorting is to take place;

rubblizing the pillars included in said horizontal area and inducing caving from the ceiling of the original mine area to produce an in-situ retort having a horizontal extent at least several times its vertical extent, and a void volume of from about 15% to 30%;

installing air inlet conduits extending into the in-situ retort volume along or adjacent the edge thereof diagonally opposite the edge where the product gas conduits extend to the in-situ retort volume; and initiating combustion adjacent said air inlet conduits while concurrently collecting product gas from said product gas conduits to produce a diagonally moving combustion front, and whereby shale oil may be withdrawn from said liquid drainage system below said air inlet conduits while said combustion front moves diagonally from said air inlet to said product gas conduits.

17. A method for the in-situ secondary recovery of shale oil and related product gases from a formation where rich oil shale has been mined for aboveground retorting by conventional horizontally extensive room and pillar mining operations, comprising the steps of:

providing a liquid drainage system for an extended horizontal area between two panel barrier pillars in the conventional mine, said drainage system being associated with a low zone of said horizontal area where the in-situ retorting operation is to take place;

installing conduits to receive product gas from the in-situ retorting operations, along or adjacent one edge of the volume where the in-situ retorting operation is to take place;

sealing said horizontal area where the in-situ retorting is to take place;

rubblizing the pillars included in said horizontal area and inducing caving from the ceiling of the original mine area to produce an in-situ retort having a horizontal extent at least several times its vertical extent, and a void volume of from about 15% to 30%;

said rubblizing being accomplished by the retreat blasting of successive pillars and mine ceiling volumes diagonally across the horizontal area where the in-situ retorting is to take place, to reduce blast effects and ground motion;

installing air inlet conduits extending into the in-situ retort volume along or adjacent the edge thereof diagonally opposite the edge where the product gas conduits extend to the in-situ retort volume; and initiating combustion adjacent said air inlet conduits while concurrently collecting product gas from said product gas conduits to produce a diagonally moving combustion front, and whereby shale oil may be withdrawn from said liquid drainage system below said air inlet conduits while said combustion front moves diagonally from said air inlet to said product gas conduits.

18. A process for extracting product gas and shale oil from oil shale comprising the steps of:

conducting horizontally extensive room and pillar mining operations in an oil shale formation for above-ground retorting operations, with many entries to the room and pillar mining areas;

providing a liquid drainage system for an extended horizontal area having a length and a width which are at least several times the height of the mined area, between two panel barrier pillars in the conventional mine, said drainage system being associated with a low zone of said horizontal area where the in-situ retorting operation is to take place;

sealing substantially all of said many entries to said horizontal area where the in-situ retorting is to take place;

installing conduits to receive product gas from the in-situ retorting operations, along or adjacent one edge of the volume where the in-situ retorting operation is to take place;

rubblizing the pillars included in said horizontal area and inducing caving from the ceiling of the original mine area to produce an in-situ retort having a horizontal extent at least several times its vertical extent, and a void volume of from about 15% to 30%;

installing air inlet conduits extending into the in-situ retort volume along or adjacent the edge thereof diagonally opposite the edge where the product gas conduits extend to the in-situ retort volume; and initiating combustion adjacent said air inlet conduits while concurrently collecting product gas from said product gas conduits and producing a diagonally moving combustion front, and whereby shale oil may be withdrawn from said liquid drainage system below said air inlet conduits while said combustion front moves diagonally from said air inlet to said product gas conduits.

* * * * *